United States Patent [19]

Brown

[11] 4,283,867

[45] Aug. 18, 1981

[54] BACKFILLING APPARATUS WITH ADJUSTABLE FILLING AUGERS

[75] Inventor: Stanley L. Brown, Lenox, Iowa

[73] Assignee: Roscoe Brown Corporation, Lenox, Iowa

[21] Appl. No.: 100,333

[22] Filed: Dec. 5, 1979

[51] Int. Cl.[3] ..... E02F 5/22

[52] U.S. Cl. ..... 37/142.5

[58] Field of Search ..... 37/142.5, 190

[56] References Cited

U.S. PATENT DOCUMENTS

| | | | |
|---|---|---|---|
| 1,677,342 | 7/1928 | Hodgen | 37/142.5 |
| 1,850,814 | 3/1932 | Snyder | 37/190 |
| 2,669,338 | 2/1954 | Kling | 37/190 |
| 2,714,775 | 8/1955 | Crawford | 37/142.5 |
| 3,471,953 | 10/1969 | Wyott | 37/142.5 |
| 4,059,911 | 11/1977 | Bean et al. | 37/142.5 |

FOREIGN PATENT DOCUMENTS

| | | | |
|---|---|---|---|
| 245578 | 11/1960 | Australia | 37/142.5 |
| 853917 | 10/1970 | Canada | 37/142.5 |

*Primary Examiner*—Clifford D. Crowder

*Attorney, Agent, or Firm*—Zarley, McKee, Thomte, Voorhees & Sease

[57] ABSTRACT

A backfilling machine having an auger with two spaced apart flighting segments thereon. One of the flighting segments has right hand flighting and the other of the segments has left hand flighting. The segments are rotated in unison so as to propel material from the side of the trench inwardly toward the space between the two flightings which space is aligned over the trench so that the filling material falls into the trench by gravity. The flightings are adjustably mounted on a central shaft for movement toward and away from one another to accommodate trenches of varying widths.

7 Claims, 4 Drawing Figures

BACKFILLING APPARATUS WITH ADJUSTABLE FILLING AUGERS

BACKGROUND OF THE INVENTION

This invention relates to a method and apparatus for backfilling trenches.

When trenches are excavated with excavating equipment, the dirt removed from the trenches is piled on opposite sides thereof. Backfilling machines have been provided which engage the dirt piles on the sides of the trenches and move the dirt toward the trench where it falls into the trench by gravity.

Heretofore, such backfilling machines have utilized an auger which has flighting thereon for driving the dirt material toward one end of the auger. The auger is mounted on the front of a vehicle and is moved along one side of the trench so as to shift the dirt laterally toward the end of the auger which is positioned adjacent the side of the trench.

When filling trenches which have been used for laying pipe or other conduits, care must be exercised not to damage the contents of the trench. Large clods or rocks can shift the pipe and can cause leaks or other damage to the pipes to develop. Accordingly, it is desirable to pulverize and mix the backfilling dirt prior to letting it drop into the trench so that it will not damage the pipe or other materials contained therein.

Because presently used backfilling devices fill the trench only from one side, it is necessary to make two passes along the trench in order to get all the dirt into the trench. One pass is made on one side of the trench and then a second pass is made on the other side of the trench.

SUMMARY OF THE INVENTION

The present invention utilizes an auger having two spaced apart flighting segments thereon. The space between the flightings is aligned over the trench and the two spaced apart flightings straddle the trench. The flightings are arranged in opposite helical directions so that when they are rotated in unison they urge the dirt which they engage toward the central space between the flighting segments.

The flighting segments are mounted upon two separate cylindrical sleeves which in turn are slidably mounted over an elongated torque shaft. The sleeves are secured to the torque shaft by bolts which extend through holes in the sleeves and additional holes provided in the torque shaft itself. The bolts can be removed and the sleeves moved longitudinally along the torque shaft to provide adjustment of the width of the space between the two flighting segments. A plurality of holes are provided in the torque shaft to permit this adjustment.

The auger flights terminate in inner ends which are positioned adjacent the space between the flighting segments. These inner ends are rotated 180° with respect to one another so that they are out of phase with one another when they are rotating. This contributes to the mixing and pulverizing of the dirt which is being conveyed toward the center space between the flightings.

The unit is driven by a variable volume piston pump driven by the diesel engine of the tractor. The pump drives a fixed volume piston motor which then drives a gear speed reducer. The gear speed reducer drives an enclosed roller chain drive. The variable volume piston pump provides infinite adjustment of the auger rotation speed from zero to 165 rpm. Overload protection is provided by relief valves in the hydraulic motor.

Therefore, a primary object of the present invention is the provision of an improved apparatus and method for backfilling trenches.

A further object of the present invention is the provision of a device which fills a trench from both sides of the trench at the same time.

A further object of the present invention is the provision of a device which pulverizes, breaks up and mixes the dirt prior to depositing the dirt in the trench.

A further object of the present invention is the provision of a device which is adjustable to accommodate trenches of different widths.

A further object of the present invention is the provision of a device which has a variable speed auger which can be adjusted to an infinite number of speeds.

A further object of the present invention is the provision of a device which is simple in operation and which may be adjusted easily with a minimum of time and effort.

A further object of the present invention is the provision of a device which is sturdy, durable and efficient.

DETAILED DESCRIPTION OF THE INVENTION

Figure 1:
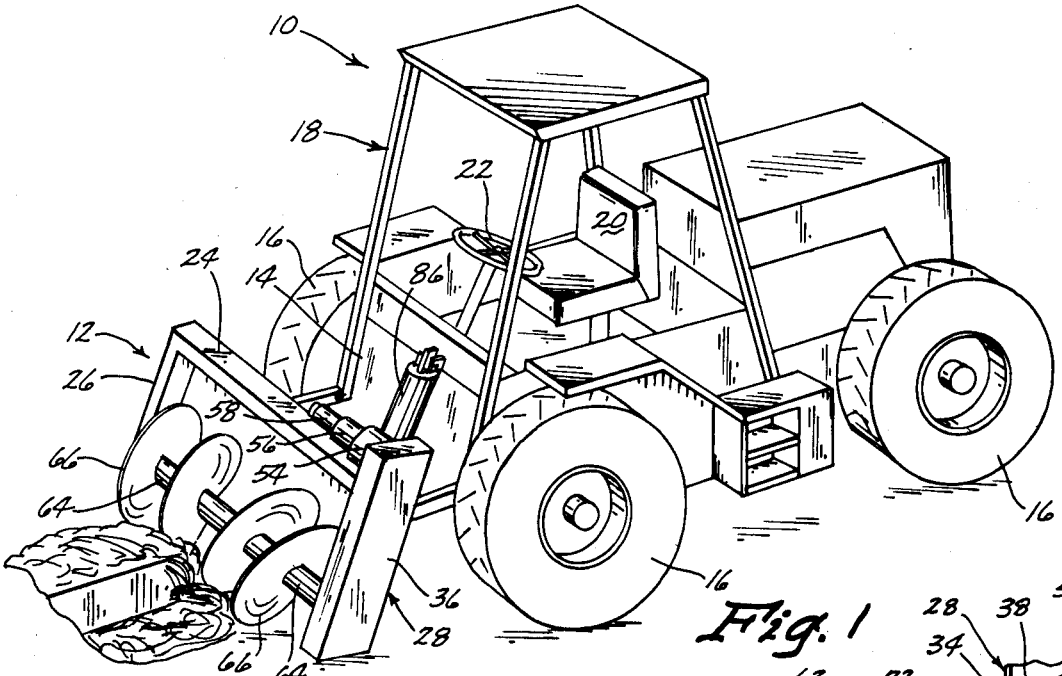
FIG. 1 is a perspective view of a vehicle having the backfilling device of the present invention mounted thereon.
Figure 2:
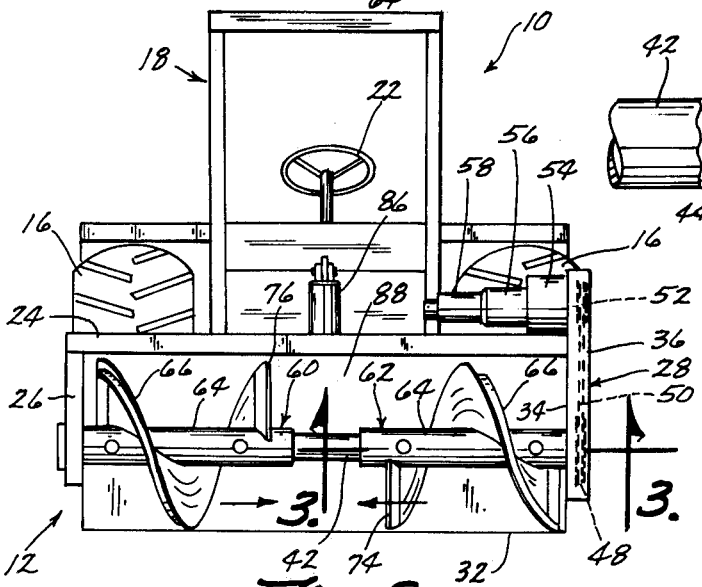
FIG. 2 is a front elevational view of the vehicle and device shown in FIG. 1.

Referring to the drawings, the numeral 10 generally designates the vehicle having a backfilling device 12 mounted on the forward end thereof. Vehicle 10 includes a body frame 14, supported by a plurality of wheels 16. A driver's cab 18 having a seat 20 and operating controls 22 is mounted toward the forward end of the vehicle 10.

Backfilling device 12 comprises a U-shaped frame formed by an upper horizontal member 24, a downwardly extending side frame member 26 and a downwardly extending chain drive box 28. Rigidly connected to upper horizontal member 24 and extending downwardly and rearwardly therefrom is a rear shield blade 30 which has a lower end 32 adapted to engage the ground in a fashion similar to that of a conventional bulldozer blade.

Figure 3:
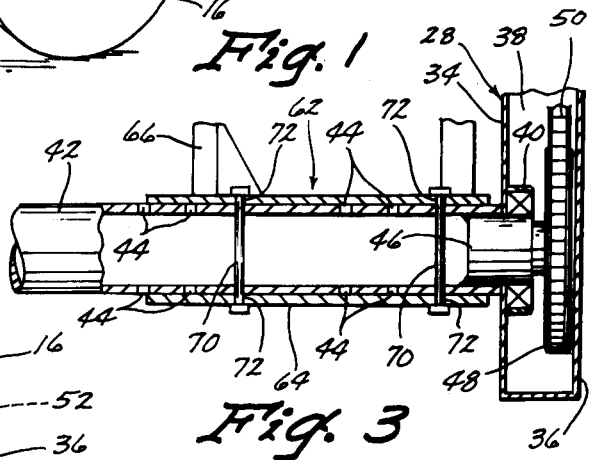
FIG. 3 is a sectional view taken along line 3—3 of FIG. 2.

Gear box 28 includes spaced apart side walls 34, 36 and is enclosed on all sides to form a compartment 38. Side wall 34 has an opening therein shown in FIG. 3, and this opening is surrounded by bearings 40. Rotatably mounted in bearings 40 is a torque shaft 42. Shaft 42 is of hollow construction and has a plurality of diametric holes 44 spaced along its length, preferably approximately two inches apart. The opposite ends of shaft 42 are each provided with a solid stub shaft 46 which is rotatably journaled in bearing 40 and which extends therethrough. A sprocket 48 is mounted on the outer end of stub shaft 46 and a chain 50 is trained around sprocket 48. The upper end of chain 50 is trained around a drive sprocket 52 which in turn is driven by a gear type speed reducer 54. Speed reducer 54 is driven by a fixed volume piston motor 56, and motor 56 is driven by a variable volume piston pump 58. The diesel engine of the vehicle drives pump 58. The variable volume piston pump provides infinite adjustability of the rotational speed of torque shaft 42 from zero to 165 rpm.

Slidably mounted over torque shaft 42 are two spaced apart flighting segments 60, 62. Each segment 60, 62 includes a hub sleeve 64 and a helical flighting 66. Sleeve 64 is slidably mounted over the outer surface of torque shaft 42 and is held rigidly thereto by means of bolts 70 which extend through holes 72 in sleeves 62 and which also extend through holes 44 in torque shaft 42. The longitudinal positions of flighting segments 60, 62 may be adjusted by removing bolts 72 and sliding sleeves 64 longitudinally on shaft 42. When the desired position is achieved, bolts 72 are extended through holes 44 of shaft 42, to secure the flightings in place. A plurality of holes 44 make possible the adjustment of the flighting segment 60, 62 to a variety of positions on shaft 42. Preferably the inner flighting ends 74, 76 are rotated 180° from one another so as to maximize the agitation and continuous movement of the material being conveyed to the center of the trench.

Figure 4:
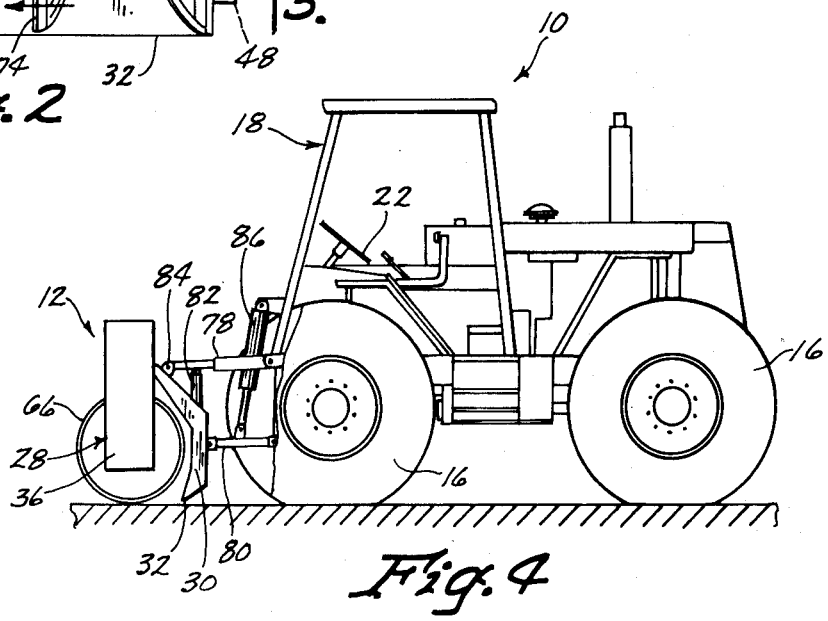
FIG. 4 is a side elevational view of the device shown in FIG. 1.

Backfilling device 12 is mounted to vehicle 10 by means of parallel upper links 78 and lower links 80 which are pivoted at their opposite ends to the vehicle frame and to the backfilling device 12 as shown in FIG. 4. Upper links 78 are telescopically extensible and a hydraulic cylinder 82 permits the adjustment of the angle of rear shield blade 30 about the pivotal axis provided at 84. The elevation of backfilling device 12 is controlled by hydraulic cylinder 86 which is connected at its upper end to vehicle 10 and at its lower end to link 80.

In operation, the auger formed by shaft 42 and flighting segments 62 is rotated as one integral unit in a direction which causes the flightings to urge material toward the central space 88 between flightings 60, 62. This is caused because the flighting on segment 62 is in one direction, and the helical flighting on segment 60 is in an opposite direction.

The auger segments can be adjusted inwardly and outwardly to accommodate trenches of varying widths. Preferably the holes 44 in torque shaft 42 are spaced at two inch intervals to permit adjustment in two inch increments.

The blade causes the filling material to be broken up and conveyed towards the center of the trench where it falls into the bottom. The filling material builds up from the bottom of the trench as the auger continues to rotate into the soil. This means that the pipe is enclosed in a jacket of nondamaging crumbled material. This significantly reduces the occurrence of damage to the pipe within the trench. The rotation of the auger not only breaks up clods and frozen material, but it also blends different materials together into a homogeneous fill. The pulverized soil flows in and around the pipe gently unlike filling methods that drop the material straight down.

The heavier rocks which are in the material are brought to the top while the lighter material flows easily ahead along the auger and consequently falls into the trench first. This causes the finer materials to be dropped onto the pipe first before the heavier materials such as rocks or clods might fall.

Consequently, the tendency of larger rocks or clods to dent or collapse the pipe within the trench are minimized. Two things cause this minimization. First, when the rocks do finally enter the trench, they are tied up by the fine granulated materials so that they do not cause serious impact damage. Second, the pulverizing action of the material causes a fill that flows rather than drops en masse.

Thus, it can be seen that the device accomplishes at least all of its stated objectives.

What is claimed is:

1. A backfiller adapted to be mounted on a vehicle comprising:

a frame having an upper frame portion and two downwardly extending spaced apart side frame members;

means for mounting said frame to said vehicle;

an elongated torque member extending between said side frame members and having its opposite ends rotatably journaled in said side frame members, first and second tube members mounted over said elongated torque member for longitudinal sliding movement along the longitudinal axis of said torque member;

helical flighting means mounted around said first and second tube members, the flighting means on said first tube member being oriented in a direction opposite from the flighting means on said second tube member;

securing means for detachably securing said first and second tube members to said torque member in a plurality of positions along the length of said torque member to permit selective adjustment of the relative positions of said first and second tube members with respect to one another;

power means connected to said torque member for imparting rotation to said torque member and said first and second tube member;

said first and second tube members each having an outer end adjacent one of said side frame members and an inner end, said inner ends of said first and second tube members being spaced apart a predetermined distance determined by the longitudinal positions of said first and second tube members on said torque member;

said securing means comprising at least one diametric hole in each of said first and second tube members, a plurality of diametric holes spaced longitudinally along the length of said torque member, and first and second bolt means extending through the diametric holes of said first and second tube members, respectively, said first and second bolt means also each extending through one of the diametric holes of said torque member.

2. A backfiller according to claim 1 wherein said means for mounting said frame to said vehicle comprises a linkage mechanism for pivotally interconnecting said frame and said vehicle so that said frame is movable vertically upwardly and downwardly with respect to said vehicle, power means interconnecting said linkage and said vehicle for causing said vertical movement of said frame.

3. A backfiller according to claim 2 wherein said power means for rotating said torque member comprises a variable speed hydraulic pump connected hydraulically to a hydraulic motor, and transmission means drivingly connecting said hydraulic motor to said torque member.

4. A backfiller according to claim 3 wherein said transmission means comprises a gear speed reducer driven by said motor and a chain drive means connected to and driven by said speed reducer.

5. A backfiller according to claim 1 wherein said helical flighting means on said first and second tube members comprise first and second flighting segments mounted on said first and second tube members, respectively; said first and second flighting segments extending helically in opposite directions from one another and terminating in inner helical ends spaced from one another adjacent the midpoint of said torque member.

6. A backfiller according to claim 5 wherein said inner helical ends of said first and second flighting segments are positioned in different rotational orientations so as to be out of phase with one another.

7. A backfiller according to claim 6 wherein said helical ends are out of phase 180° with respect to one another.

* * * * *